US007929880B2

(12) United States Patent
Kobashi

(10) Patent No.: US 7,929,880 B2
(45) Date of Patent: Apr. 19, 2011

(54) CLEANING BLADE ANTI-PEELING APPARATUS, IMAGE FORMING APPARATUS, AND CLEANING BLADE ANTI-PEELING METHOD

(75) Inventor: Masaru Kobashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 267 days.

(21) Appl. No.: 12/268,259

(22) Filed: Nov. 10, 2008

(65) Prior Publication Data

US 2009/0129810 A1 May 21, 2009

(30) Foreign Application Priority Data

Nov. 15, 2007 (JP) ..... 2007-296361

(51) Int. Cl.
*G03G 15/16* (2006.01)
*G03G 21/00* (2006.01)

(52) U.S. Cl. ..... 399/101; 399/353; 399/354

(58) Field of Classification Search ..... 399/353, 399/354, 349, 358, 101
See application file for complete search history.

(56) References Cited

U.S. PATENT DOCUMENTS

| | | | | |
|---|---|---|---|---|
| 6,311,031 | B1 * | 10/2001 | Hirano | 399/101 |
| 6,480,695 | B2 | 11/2002 | Endo et al. | |
| 7,519,309 | B2 * | 4/2009 | Miyamoto et al. | 399/101 |
| 7,536,147 | B2 * | 5/2009 | Kageyama | 399/349 |

FOREIGN PATENT DOCUMENTS

| | | | |
|---|---|---|---|
| JP | 05-197319 | | 8/1993 |
| JP | 05197317 | A | 8/1993 |
| JP | 07-168458 | | 7/1995 |
| JP | 07-334012 | | 12/1995 |
| JP | 2002031997 | A | 1/2002 |
| JP | 2004264700 | A | 9/2004 |
| JP | 2007-225834 | | 9/2007 |

* cited by examiner

*Primary Examiner* — Susan S Lee
(74) *Attorney, Agent, or Firm* — DLA Piper LLP (US)

(57) ABSTRACT

A cleaning blade anti-peeling apparatus includes a transfer apparatus that transfers a toner image formed on an image carrier to an endless transfer member. An image carrier cleaning member captures toner remaining on the image carrier after the toner image is transferred. A cleaning recovery member recovers the toner on the image carrier cleaning member. A bias applying apparatus applies a bias voltage to move the toner of the image carrier cleaning member to the image carrier. An endless transfer member cleaning blade removes toner adhering to the endless transfer member after the toner image of the endless transfer member is transferred to a transfer material while abutting against the endless transfer member. The following relationship is satisfied: cleaning recovery member width<endless transfer member cleaning blade width<image carrier cleaning member width.

6 Claims, 3 Drawing Sheets

CLEANING BLADE ANTI-PEELING APPARATUS, IMAGE FORMING APPARATUS, AND CLEANING BLADE ANTI-PEELING METHOD

BACKGROUND

1. Technical Field

The present invention relates to a technique of a cleaning blade anti-peeling apparatus which removes toner adhering to an endless transfer unit which transports a transfer material, such as transfer paper after a toner image is transferred to a transfer material and toner remaining in the endless transfer unit which transports the toner image after the toner image is transferred to the transfer material. The invention still relates to a technique of an image forming apparatus equipped with the cleaning blade anti-peeling apparatus made up of an electrophotographic device, such as an electrostatic copier, a printer, and a facsimile, and a cleaning blade anti-peeling method.

2. Related Art

As for an image forming apparatus made up of an electrophotographic device, JP-A-1995-334012 discloses an image forming apparatus which transfers a toner image of a photoconductor to a transfer material, for example transfer paper which is transported by an endless transfer belt which is an endless transfer unit. In the image forming apparatus disclosed in the patent document, toner (toner base particles and additive) adhering to a transfer belt is removed by a cleaning blade which is in contact with the transfer belt after a transfer of a toner image to a transfer material or at the time of occurrence of jam of the transfer material. In such a case, if toner is not supplied to both end portions of the cleaning blade, both end portions of the cleaning blade are likely to peel off.

For such a reason, in the image forming apparatus disclosed in the patent document, the toner image is periodically formed at an area other than an image forming area of the toner image transferred to a typical transfer material to prevent a blade from peeling, and the toner image for blade anti-peeling (blade anti-peeling toner image) is supplied to both ends of the cleaning blade by the transfer belt. Therefore, since toner base particles and additive of the supplied blade anti-peeling toner image functions as lubricant, it is possible to prevent the cleaning blade from peeling.

However, in the image forming apparatus disclosed in the patent document, when toner is supplied to both end portions of the cleaning blade, the blade anti-peeling toner image must be formed. Accordingly, redundant toner which does not contribute to formation of an actual image is needed and thus consumption of the toner increases. Further, there is need for a control process for forming the cleaning blade anti-peeling toner image, so the control of the image formation becomes complex.

Further, the patent document discloses that a pair of specific image forming units is additionally provided in order to form a blade anti-peeling toner image besides an image forming unit for forming an image to a typical transfer material. Accordingly, owing to the additional specific image forming units, the size of the apparatus is increased, resulting in the increase of cost.

SUMMARY

It is an object of the invention is to provide a cleaning blade anti-peeling apparatus, an image forming apparatus equipped with the cleaning blade anti-peeling apparatus, and a cleaning blade anti-peeling method which is capable of effectively and easily preventing a cleaning blade of an endless transfer member from peeling without formation of a toner image for blade anti-peeling.

In the cleaning blade anti-peeling apparatus and method according to the invention, a width of a cleaning recovery member, a width of an intermediate transfer member cleaning blade, and a width of an image carrier cleaning member W are set so as to satisfy a relationship, a width of a cleaning recover member<a width of an intermediate transfer member cleaning blade<a width of an image carrier cleaning member W. With such a setting, it is possible to deposit some portion of toner to adhere to the image carrier after a transfer at both end portions of the image carrier cleaning member other than a typical image forming area. Accordingly, it is possible to move toner at both end portions of the image carrier cleaning member to the image carrier by applying a bias voltage to the image carrier cleaning member and to supply the toner, which is moved to the image carrier, to both end portions of an endless transfer member cleaning blade via an endless transfer member. With such a scheme, since the supplied toner functions as lubricant, it is possible to effectively prevent both end portions of the endless transfer member from peeling.

Particularly, like the structure disclosed in the patent document, since it is not necessary to form the blade anti-peeling toner image, there is no need for redundant toner. Accordingly, it is possible to effectively prevent the endless transfer member cleaning blade from peeling while suppressing the toner consumption. Moreover, there is no need for control for forming the blade anti-peeling toner image and thus the control for image formation does not become complex and it is possible to prevent the endless transfer member cleaning blade from peeling in a simple manner.

Further, there is no need for a specific image forming unit for forming the blade anti-peeling toner image. Accordingly, it is possible to inhibit the size of the entire body of the apparatus from being increased and suppress the increase in cost.

On the other hand, an image forming apparatus is equipped with cleaning blade anti-peeling apparatus. Accordingly, it is possible to inhibit chattering of the endless transfer member cleaning blade and uneven cleaning of the endless transfer member which is performed by the endless transfer member cleaning blade and it is possible to obtain an image with good and stable image quality for a long period.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, preferred embodiments of the invention will be described with reference to the accompanying drawings.

Figure 1:
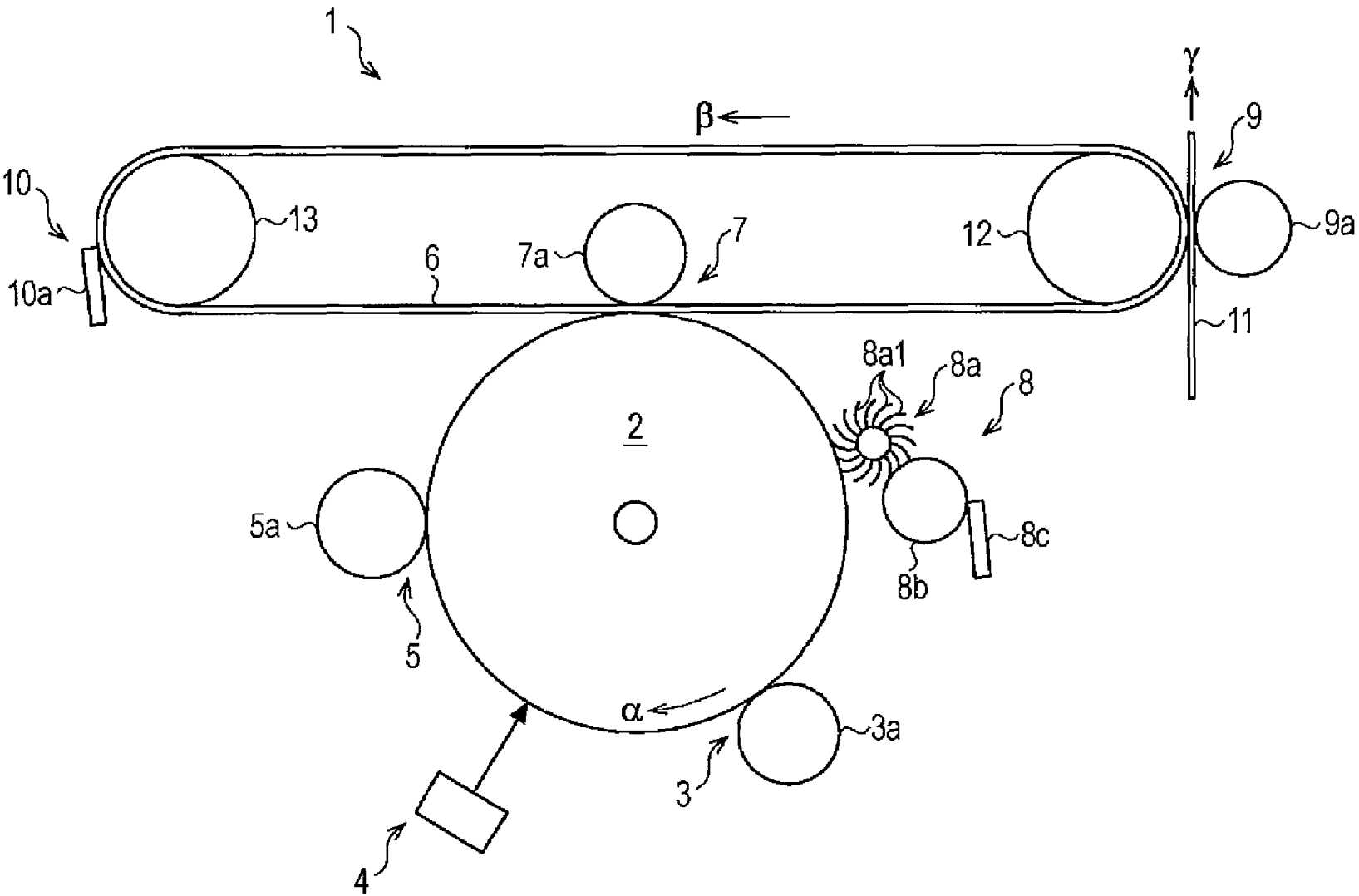
FIG. 1 is a schematic and a partial view illustrating an image forming apparatus according to one embodiment of the invention.

FIG. 1 is a schematic and partial view illustrating an image forming apparatus according to one embodiment of the invention.

As shown in FIG. 1, an image forming apparatus 1 is provided with a photoconductor 2 which is an image carrier on which an electrostatic latent image and a toner image are formed. A charger 3 which electrically charges the photoconductor 2 is installed around an external circumference of the photoconductor 2. In addition, an exposing apparatus 4 which writes the electrostatic latent image to the photoconductor 2, a developing apparatus 5 which develops the electrostatic latent image of the photoconductor 2 with toner, a primary transfer apparatus 7 which primarily transfers a toner image of the photoconductor 2 to an intermediate transfer belt 6 which is an endless transfer member, and a photoconductor cleaning apparatus 8 are arranged on the side of the external circumference of the photoconductor 2 in order along a way from the charger 3 in a rotating direction a of the photoconductor 2 (in a clockwise direction of FIG. 1). On the side of the primary transfer apparatus 7 in a rotating direction β (in a counterclockwise direction of FIG. 1) of the intermediate transfer belt 6, a secondary transfer apparatus 9 is provided. Further, an intermediate transfer belt cleaning apparatus 10 is provided in front of the primary transfer apparatus 7 and on the side of the secondary transfer apparatus 9 in the rotating direction D of the intermediate transfer belt 6. The image forming apparatus 1 (not shown) includes a fixing apparatus disposed on the side of the secondary transfer apparatus 9 in a transporting direction γ of a transfer material 11 like the known general image forming apparatus (not shown). A transfer paper receiving cassette tray is provided on the side of the secondary transfer apparatus 9 in a reverse direction to the transporting direction γ of the transfer material 11. Further, a transfer material transporting apparatus by which a transfer material 11 is transported to a paper discharge cassette from the transfer paper receiving cassette through the second transfer apparatus 9 and the fixing apparatus is provided.

The photoconductor 2 is made up of a photoconductor drum. A photosensitive layer having a predetermined layer thickness is formed on an external circumference surface of a cylinder-shaped metallic tube like the known photoconductor drum. As for the metallic tube in the photoconductor 2, a conductive pipe, for example an aluminum pipe is used. The photosensitive layer is formed of a known organic photosensitive material. The photoconductor 2 can be other photoconductors other than the photosensitive drum.

The charger 3 has a charging roller 3*a* which is in contact with the photoconductor 2 and electrically charges the photoconductor 2. As a charging bias voltage is applied to the charging roller 3*a*, the photoconductor 2 is electrically charged. A charging method of the charger 3 is not limited to direct contact charging by the charging roller 3*a*. That is, a known charger which performs direct charging or indirection charging may be used as the charger.

The exposing apparatus 4 writes an electrostatic latent image to the photoconductor 2 by irradiating the photoconductor 2 with light, such as layer beams. The exposing apparatus 4 can use any types of known exposing chargers. The developing apparatus 5 transports toner regulated on a developing roller 5*a* so as to have a predetermined layer thickness toward the photoconductor 2 by the developing roller 5*a* and develops the electrostatic latent image on the photoconductor 2 with toner to form a toner image on the photoconductor 2.

The primary transfer apparatus 7 transfers the toner image on the photoconductor 2 to the intermediate transfer belt 6 by a transfer roller 7*a*. The intermediate transfer belt 6 is made up of an endless belt. The intermediate transfer belt 6 is stretched between a driving roller 12 to which driving force of a motor (not shown) is transferred and a driven roller 13.

A photoconductor cleaning apparatus 8 includes a photoconductor cleaning brush 8*a* which is a conductive image carrier cleaning member, a cleaning recovery roller 8*b* which is a conductive cleaning recovery member, and a recovery roller cleaning blade 8*c* which is a cleaning member of a recovery roller.

The conductive photoconductor cleaning brush 8*a* has a plurality of brush hairs $\mathbf{8}a_1$ and can be made up of a known brush roller for electric charging. The photoconductor cleaning brush 8*a* is rotatably provided perpendicularly intersecting the rotating direction α of the photoconductor 2 and being in contact with the photoconductor 2 in a widthwise direction (a rotating axis direction of the photoconductor 2). In this case, a moving direction of the surface of the photoconductor 2 and a moving direction of the surface of the photoconductor cleaning brush 8*a* can be arbitrarily set. However, it is preferable that the moving direction of the surface of the photoconductor 2 and the moving direction of the surface of the photoconductor cleaning brush 8*a* be reverse to each other.

Figure 2:
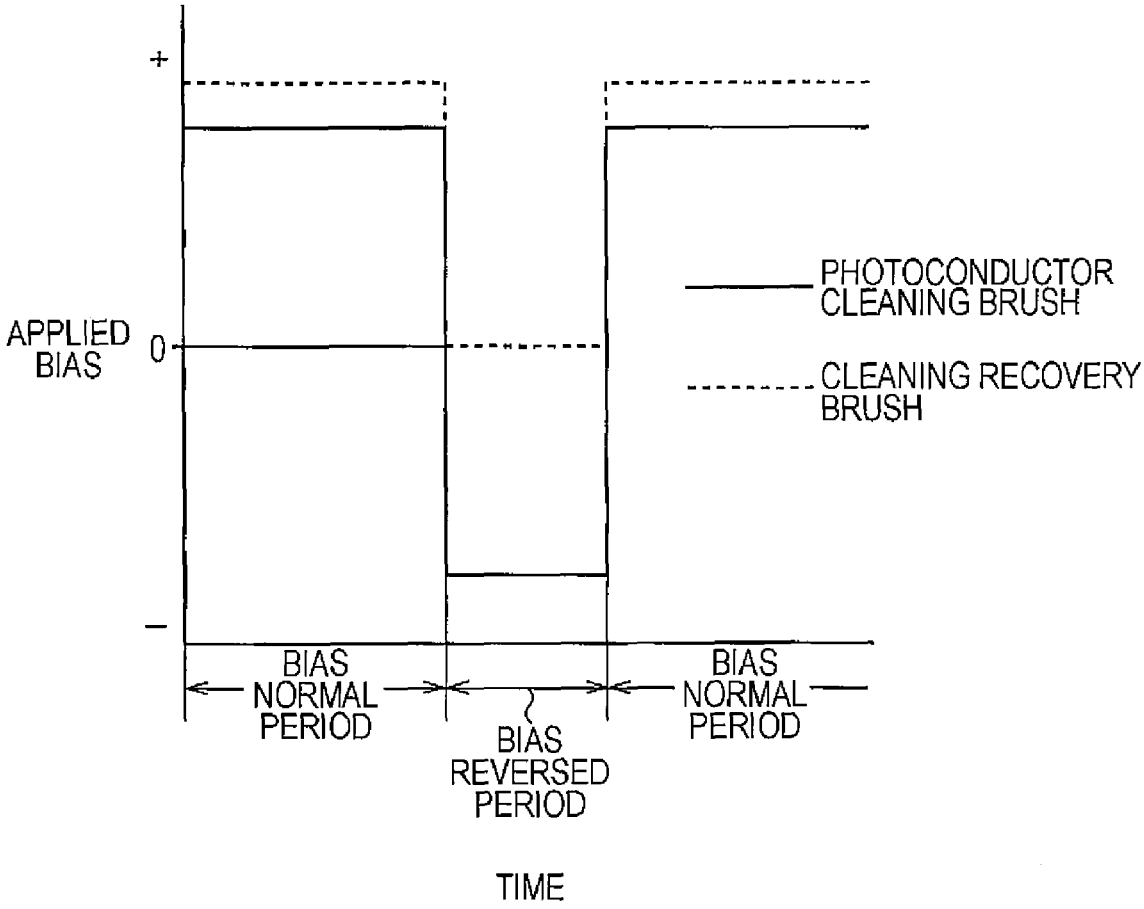
FIG. 2 is an explanatory view illustrating bias voltages applied to a photoconductor cleaning brush and a cleaning recovery roller, respectively.

The photoconductor cleaning brush 8*a* is applied with a bias voltage by a bias applying apparatus (not shown). The photoconductor cleaning brush 8*a* rotates in a state in which a bias voltage (normal bias period) which has an opposite polarity to a potential of the toner is applied thereto as indicated by a solid line of FIG. 2, and the brush hairs $\mathbf{8}a_1$ rub the surface of the photoconductor 2. Accordingly, the toner which is the residue on the photoconductor 2 after the primary transfer is captured by the brush hairs $\mathbf{8}a_1$.

Next, as indicated by the solid line of the same figure, the bias voltage applied to the photoconductor cleaning brush 8*a* is reversed (reversed bias period). Accordingly, the captured toner can be moved (returned) to the photoconductor 2. The timing of reversing the bias voltage can be arbitrarily set. For example, the bias reversing timing may be set by performing bias reversion for a preset period when a patch operation stops (at switching-on time of the apparatus), every time when 100 sheets are printed in the case of consecutively printing images with a low density pattern which is not higher than 3%, or after a predetermined number of sheets (for example, 500 sheets) is printed.

The conductive cleaning recovery roller 8*b* can be a known conductive roller for charging. The cleaning recovery roller 8*b* is installed in contact with the brush hairs $\mathbf{8}a_1$ of the photoconductive cleaning brush 8*a* in a posture of perpendicularly intersecting a rotating direction of the photoconductor cleaning brush 8*a* and in a widthwise direction of the photoconductor cleaning brush 8*a* (a rotating direction of the photoconductor cleaning brush 8*a*). The cleaning recovery roller 8*b* is also applied with a bias voltage by the bias applying apparatus (not shown). As indicated by a dotted line of FIG. 2, the cleaning recovery roller 8*b* rotates and is rubbed by the brush hairs $\mathbf{8}a_1$ of the photoconductor cleaning brush 8*a* in a state in which a bias voltage with an opposite polarity to a potential of toner (a bias voltage higher than the bias voltage of the photoconductor cleaning brush 8*a*) is applied. In such a manner, it is possible to recover a predetermined amount of captured toner of the photoconductor cleaning brush 8*a*. The cleaning recovery roller 8*b* indicated by the dotted line of the figure causes the toner easily to be moved to the photoconductor 2 by creating a condition in which the toner is not attracted to the cleaning recovery roller 8*b* from the photoconductor cleaning brush 8*a* by setting the bias voltage applied to the photoconductor cleaning brush 8*a* when the bias voltage is reversed to zero (0).

In addition, the recovery roller cleaning blade 8*c* can be made up of a known cleaning blade. The recovery roller cleaning blade 8*c* is provided so as to perpendicularly intersect a rotating direction of the cleaning recovery roller 8*b* and to be in contact with the surface of the cleaning recovery roller 8*b* in a widthwise direction of the cleaning recovery roller 8*b* (a rotating direction of the cleaning recovery roller 8*b*). Since the recovery roller cleaning blade 8*c* is provided so as to clean the cleaning recovery roller 8*b* by removing the toner deposited on the cleaning recovery roller 8*b* while not moving the toner to the photoconductor cleaning brush 8*a* by rubbing the surface of the cleaning recovery roller 8*b*.

The secondary transfer apparatus 9 transfers the toner image on the intermediate transfer belt 6 to the transfer material 11 by the transfer roller 9*a*. The intermediate transfer cleaning apparatus 10 has the intermediate transfer belt cleaning blade 10*a* which is the endless transfer member cleaning blade which is in contact with the surface of the intermediate transfer belt 6 in a direction of perpendicularly intersecting the moving direction β of the intermediate transfer belt 6. The intermediate transfer belt cleaning blade 10*a* is provided in contact with the transfer belt 6 in a separable manner. The intermediate transfer belt cleaning blade 10*a* can be provided so as to be always in contact with the intermediate transfer belt 6. Further, the intermediate transfer belt cleaning blade 10*a* is provide to clean the intermediate transfer belt 6 by removing transfer residue toner on the intermediate transfer belt 6 after the second transfer by rubbing the surface of the intermediate transfer belt 6.

Figure 3:
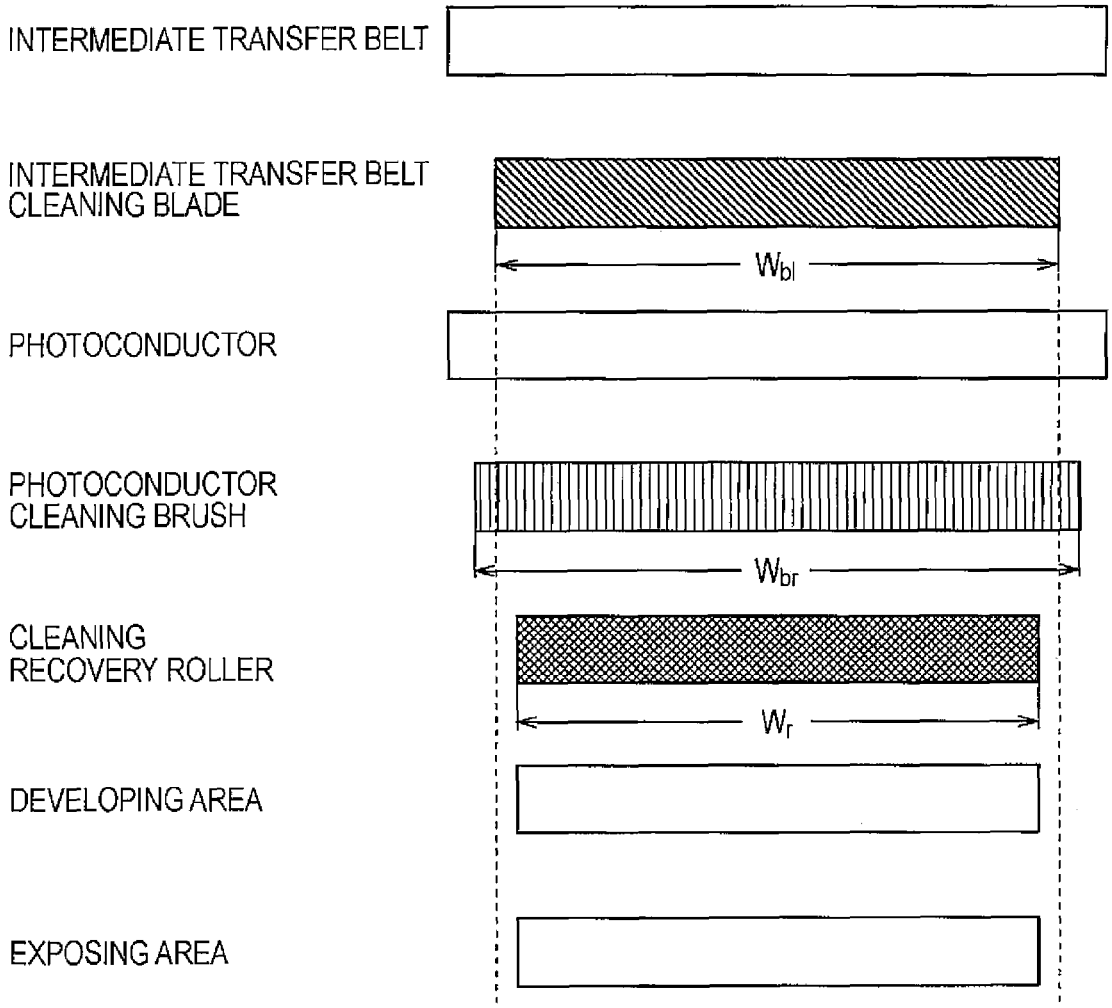
FIG. 3 is a view illustrating a relationship among widths of members of the image forming apparatus according to one embodiment of the invention.

By the way, as shown in FIG. 3, in the image forming apparatus 1 according to the embodiment, a width of the intermediate transfer belt cleaning blade 10*a* (a length of the intermediate transfer belt 6 in a widthwise direction) $W_{b1}$ is set to be smaller than a width of the photoconductor cleaning brush 8*a* $W_{br}$ (a length of the photoconductor cleaning brush 8*a* in a rotating axis direction). Still further, a width $W_{b1}$ of the intermediate transfer belt cleaning blade 10*a* is set to be larger than a width $W_r$ of the cleaning recovery roller 8*b* (a length of the cleaning recovery roller 8*b* in the rotating axis direction). That is, $W_r<W_{b1}<W_{br}$. The intermediate transfer belt cleaning blade 10*a*, the photoconductor cleaning brush 8*a*, and the cleaning recovery roller 8*b* are arranged in such a manner that the center of the width of the intermediate transfer belt cleaning blade 10*a*, the center of the width of the photoconductor cleaning brush 8*a*, and the center of the width of the cleaning recovery roller 8*b* are at the same position.

Both of a width of the photoconductor 2 and a width of the intermediate transfer belt 6 are arbitrarily set as long as each of them are greater than a width of the photoconductor cleaning brush 8*a*. In such a case, the width of the photoconductor 2 and the width of the intermediate transfer belt 6 can be set to be equal to each other or to be different from each other. Each of a width of a developing area of the developing roller 5*a* and a width of an exposing area of the exposing apparatus 4 is set to be equal to the width $W_r$ of the cleaning recovery roller 8*b* or smaller than the width $W_r$. In such a case, the width of the developing area and the width of the exposing area can be set to be equal to each other. Alternatively, the width of the developing area can be set to be larger than the width of the exposing area.

In the image forming apparatus 1 having the above-described structure, like the generally known image forming apparatus having an intermediate transfer belt, the photoconductor 2 is uniformly electrically charged by the charger 3 at the time of image forming operation. Next, the electrostatic latent image is written onto the photoconductor 2 which is uniformly electrically charged by exposure operation of the exposing apparatus 4 to the photoconductor 2. Next, the electrostatic latent image on the photoconductor 2 is developed by the developing apparatus 5, and the toner image is formed on the photoconductor 2. The toner image on the photoconductor 2 is transferred onto the intermediate transfer belt 6 by the primary transfer apparatus 7. The toner image transferred onto the intermediate transfer belt 6 is transferred to the transfer material 11, such as paper by the secondary transfer apparatus 9. The toner image transferred to the transfer material 11 is fixed by the fixing apparatus and an image is formed on the transfer material 11.

On the other hand, at the time of image forming operation, the photoconductor cleaning brush 8*a* and the cleaning recovery roller 8*b* are applied with a bias voltage having a reverse polarity to a potential of the toner. Accordingly, transfer residue toner remaining on the photoconductor 2 after the primary transfer is effectively captured by the photoconductor cleaning brush 8*a*. The toner captured by the photoconductor cleaning brush 8*a* is recovered by the cleaning recovery roller 8*b*. The toner recovered on the cleaning recover roller 8*b* is removed by the recovery roller cleaning blade 8*c* and the cleaning recovery roller 8*b* is cleaned.

The transfer residue toner remaining on the intermediate transfer belt 6 after the secondary transfer is removed by the intermediate transfer belt cleaning blade 10*a* of the intermediate transfer belt cleaning apparatus 10, and the intermediate transfer belt 6 is cleaned.

The image forming apparatus 1 according to the embodiment is provided so as to satisfy the relationship, the width $W_r$ of the cleaning recovery roller 8*b*<the width $W_{b1}$ of the intermediate transfer belt cleaning blade 10*a*<and the width $W_{br}$ of the photoconductor cleaning brush 8*a*. Accordingly, when the toner, which is captured on the width $W_{br}$ of the photoconductor cleaning brush 8*a* from the photoconductor 2, is recovered by the cleaning recover roller 8*b*, the toner which adheres to an area of the photoconductor cleaning brush 8*a* which is not in contact with the cleaning recovery roller 8*b* (an area of the photoconductor cleaning brush 8*a* between both ends of the photoconductor cleaning brush 8*a* and both ends of the cleaning recovery roller 8*b*) is not recovered, but is deposited at the area of the photoconductor cleaning brush 8*a* (i.e. at both end portions of the photoconductor cleaning brush 8*a*). In such a case, if a moving direction of the surface of the photoconductor 2 and a moving direction of the surface of the photoconductor cleaning brush 8*a* are opposite to each other, the progress of deposition of the toner of the photoconductor cleaning brush 8*a* is accelerated.

In such a case, as described above, a bias voltage applied to the photoconductor cleaning brush 8*a* is reversed at preset timing. At this time, the bias voltage applied to the cleaning recovery roller 8*b* becomes almost zero (0). As a result, the toner deposited on both end portions of the photoconductor cleaning brush 8*a* is moved to the photoconductor 2 and is removed from the photoconductor cleaning brush 8*a*. The toner moved to the photoconductor 2 is transferred to both edge portions of the intermediate transfer belt 6 by the primary transfer apparatus 7, and then is transported to the intermediate transfer belt cleaning blade 10*a* by the intermediate transfer belt 6.

The toner adhering to both edge portions of the intermediate transfer belt 6 is disposed at both end portions of the intermediate transfer belt cleaning blade 10*a*. In such a manner, a very small amount of toner (toner base particles and additive) is supplied to both end portions of the intermediate transfer belt cleaning blade 10*a*. Accordingly, since a small amount of toner base particles and additive supplied to both end portions of the intermediate transfer belt cleaning blade

10*a* functions as lubricant between the intermediate transfer belt cleaning blade 10*a* and the intermediate transfer belt 6, it is possible to prevent both end portions of the intermediate transfer belt cleaning blade 10*a* from peeling.

In this manner, with this embodiment, the cleaning blade anti-peeling apparatus includes the image carrier 1, the primary transfer apparatus 7, the photoconductor cleaning brush 8*a*, the bias applying apparatus which applies a bias voltage to the photoconductor cleaning brush 8*a*, the cleaning recovery roller 8*b*, and the intermediate transfer belt cleaning blade 10*a*.

According to the cleaning blade anti-peeling apparatus and the cleaning blade anti-peeling method of the embodiment, the relationship, the width $W_r$ of the cleaning recovery roller 8*b* <the width $W_{bl}$ of the intermediate transfer belt cleaning blade 10*a* <the width $W_{br}$ of the photoconductor cleaning brush 8*a*, is satisfied. With such a setting, some portion of the toner adhering to the photoconductor 2 after the transfer can be deposited on both end portions of the photoconductor cleaning brush 8*a* other than a normal image forming area. Accordingly, the toner of both end portions of the photoconductor cleaning brush 8*a* is moved to the photoconductor 2 by applying a bias voltage to the photoconductor cleaning brush 8*a*, and the toner moved to the photoconductor 2 can be supplied to both end portions of the intermediate transfer belt cleaning blade 10*a* via the intermediate transfer belt 6. For such a reason, the supplied toner functions as lubricant, it is possible to effectively prevent both end portions of the intermediate transfer belt cleaning blade 10*a* from peeling.

In such a case, since the blade anti-peeling toner image is not formed as disclosed in the patent document, there is no need for redundant toner, and it is possible to prevent the intermediate transfer belt cleaning blade 10*a* from peeling while suppressing toner consumption with high efficiency. Furthermore, there is no need for the control for forming the blade anti-peeling toner image, and therefore the image formation control does not become complex. In addition, it is possible to prevent the intermediate transfer belt cleaning blade 10*a* from peeling in a simple manner.

In addition, a specific image forming unit for forming the blade anti-peeling toner image becomes unnecessary as disclosed in the patent document. Accordingly, it is possible to inhibit the whole apparatus from increasing to a large size and it is possible to suppress the increase in cost. Further, if the intermediate transfer belt cleaning blade 10*a* and the intermediate transfer belt 6 are in contact with each other in a separable manner, the intermediate transfer belt cleaning blade 10 is likely to easily peel off. Accordingly, in the case in which the intermediate transfer belt cleaning blade 10*a* and the intermediate transfer belt 6 are provided in contact with each other in a separable manner by preventing the intermediate transfer belt cleaning blade 10*a* from peeling like the image forming apparatus 1 according to the embodiment, it is possible to effectively prevent the cleaning blade 10*a* from peeling.

According to the image forming apparatus 1 according to the invention, it is equipped with the cleaning blade anti-peeling apparatus. Accordingly, it is possible to suppress chattering of the intermediate transfer belt cleaning blade 10*a* and uneven cleaning of the intermediate transfer belt 6 by the intermediate transfer belt cleaning blade, and therefore it is possible to obtain an image having stable and good quality for a long period in a simple manner.

The invention is not limited to the example according to the above-mentioned embodiment, various changes, variations, modification, and alterations can be made within the scope of the claims. For example, although the invention is explained with an example in which the invention is applied to the image forming apparatus using a toner transfer belt. However, the invention can be applied to an image forming apparatus equipped with an endless transfer belt which transports transfer paper on which a toner image of the photoconductor is transferred like the image forming apparatus disclosed in the patent document. Further, the invention can be also applied to an image forming apparatus equipped with an endless transfer member, such as a transfer drum. The invention can be applied to any kinds of image forming apparatuses as long as the image forming apparatus is equipped with a cleaning blade which cleans an endless transfer member by abutting against the endless transfer member.

The entire disclosure of Japanese Patent Application No. 2007-296361, filed Nov. 15, 2007 is expressly incorporated by reference herein.

What is claimed is:

1. A cleaning blade anti-peeling apparatus comprising:

an image carrier on which a toner image is formed;

a transfer apparatus which transfers the toner image of the image carrier to an endless transfer member;

an image carrier cleaning member which captures toner remaining on the image carrier after the toner image is transferred;

a cleaning recovery member which recovers the toner on the image carrier cleaning member;

a bias applying apparatus which moves the toner of the image carrier cleaning member to the image carrier by applying a bias voltage to the image carrier cleaning member; and an endless transfer member cleaning blade which removes toner adhering to the endless transfer member after the toner image of the endless transfer member is transferred to a transfer material while abutting against the endless transfer member, wherein the cleaning blade anti-peeling apparatus is structured to satisfy a relationship, a width of the cleaning recovery member<a width of the endless transfer member cleaning blade<a width of the image carrier cleaning member.

2. The cleaning blade anti-peeling apparatus according to claim 1, wherein the endless transfer member cleaning blade is provided to the endless transfer member in such a manner that it can be separated from the endless transfer member.

3. The cleaning blade anti-peeling apparatus according to claim 1, wherein the image carrier cleaning member is a cleaning brush.

4. The cleaning blade anti-peeling apparatus according to claim 1, wherein the image carrier cleaning member abuts against the image carrier in such a manner that a moving direction thereof is a direction which is opposite to a moving direction of the image carrier.

5. An image forming apparatus comprising the cleaning blade anti-peeling apparatus according to claim 1, wherein an electrostatic latent image is formed on the image carrier, and further comprising at least a charging apparatus which electrically charges the image carrier;

an exposing apparatus which writes the electrostatic latent image by exposing the image carrier;

a developing apparatus which forms the toner image on the image carrier by developing the electrostatic latent image on the image carrier with toner;

a primary transfer apparatus which transfers the toner image on the image carrier to the endless transfer member;

a secondary transfer apparatus which transfers the toner image of the endless transfer member to the transfer material; and a fixing apparatus which fixes the toner image transferred to the transfer material.

6. A cleaning blade anti-peeling method comprising:

setting a width of an image carrier cleaning member which captures toner remaining on an image carrier after a toner image is transferred, a width of a cleaning blade which cleans an endless transfer member by abutting against the endless transfer member to which toner is moved from the image carrier, and a width of a cleaning recovery member which recovers toner of an image carrier cleaning member so as to satisfy a relationship, the width of the cleaning recovery member<the width of the endless transfer member cleaning blade<the width of the image carrier cleaning member, the method comprising:

moving toner which is not recovered by the cleaning recovery member of the toner of the image carrier cleaning member to the image carrier by applying a bias voltage to the image carrier cleaning member; and supplying toner moved to the image carrier to both end portions of the endless transfer member cleaning blade by the endless transfer member, wherein the endless transfer member cleaning blade is prevented from peeling off.

* * * * *